US008117964B2

(12) United States Patent
Moreau

(10) Patent No.: US 8,117,964 B2
(45) Date of Patent: Feb. 21, 2012

(54) PROCESS AND APPARATUS FOR PROVIDING IDENTITY MARKS ON SECURITY DOCUMENTS

(75) Inventor: Vincent Moreau, Lausanne (CH)

(73) Assignee: KBA—Giori S.A., Lausanne (CH)

( * ) Notice: Subject to any disclaimer, the term of this patent is extended or adjusted under 35 U.S.C. 154(b) by 389 days.

(21) Appl. No.: 10/592,646

(22) PCT Filed: Mar. 23, 2005

(86) PCT No.: PCT/CH2005/000169

§ 371 (c)(1),
(2), (4) Date: Sep. 13, 2006

(87) PCT Pub. No.: WO2005/090088

PCT Pub. Date: Sep. 29, 2005

(65) Prior Publication Data

US 2007/0204755 A1 Sep. 6, 2007

(30) Foreign Application Priority Data

Mar. 24, 2004 (EP) ..... 04405180

(51) Int. Cl.
*B41M 1/10* (2006.01)

(52) U.S. Cl. ..... 101/170; 101/153

(58) Field of Classification Search ..... 101/153, 101/170, 168; 347/224
See application file for complete search history.

(56) References Cited

U.S. PATENT DOCUMENTS

| | | | | |
|---|---|---|---|---|
| 2,164,270 | A * | 6/1939 | George | 101/153 |
| 3,390,631 | A * | 7/1968 | Koszul | 101/155 |
| 3,741,118 | A * | 6/1973 | Carley | 101/451 |
| 4,516,496 | A * | 5/1985 | Giori | 101/152 |
| 4,579,754 | A | 4/1986 | Maurer et al. | |
| 4,629,215 | A * | 12/1986 | Maurer et al. | 283/94 |
| 4,740,269 | A | 4/1988 | Berger et al. | |
| 5,062,359 | A | 11/1991 | Giori | |
| 5,812,179 | A * | 9/1998 | Pensavecchia et al. | 347/256 |
| 5,853,446 | A * | 12/1998 | Carre et al. | 65/17.3 |
| 5,899,145 | A | 5/1999 | Schaede | |
| 6,516,716 | B1 * | 2/2003 | Robertson et al. | 101/41 |
| 6,631,676 | B2 * | 10/2003 | Weichmann et al. | 101/170 |
| 6,640,713 | B2 * | 11/2003 | Landsman | 101/467 |
| 6,694,880 | B1 * | 2/2004 | Mori et al. | 101/467 |
| 7,137,697 | B2 * | 11/2006 | Lehmann | 347/103 |
| 7,338,749 | B2 * | 3/2008 | Kunita | 430/306 |
| 2002/0001776 | A1 * | 1/2002 | Mori et al. | 430/302 |
| 2002/0059876 | A1 * | 5/2002 | Fukumori et al. | 101/170 |
| 2003/0124466 | A1 * | 7/2003 | Goodin | 430/320 |
| 2005/0035983 | A1 * | 2/2005 | Cruchon-Dupeyrat et al. | 346/140.1 |

FOREIGN PATENT DOCUMENTS

| | | |
|---|---|---|
| EP | 0 047 165 A | 3/1983 |
| EP | 0 406 157 A1 | 5/1994 |
| EP | 0 873 866 A1 | 3/1998 |
| JP | 10-86318 | 4/1998 |
| JP | 10-151722 | 6/1998 |
| WO | WO 98/36913 A | 8/1998 |
| WO | WO 03/103962 A1 | 12/2003 |

* cited by examiner

*Primary Examiner* — Anthony Nguyen
(74) *Attorney, Agent, or Firm* — Clifford W. Browning; Krieg DeVault LLP

(57) ABSTRACT

An intaglio-printing press for printing security documents comprising a plate cylinder (4) with at least one engraved printing plate (6), an impression cylinder (3), a wiping device (10) and an inking system, (5, 7*a*-8*d*); it further comprises a laser marking device with laser marking heads (15) arranged facing said plate cylinder downstream from said wiping device and upstream from the contact zone between said plate cylinder and said impression cylinder.

5 Claims, 3 Drawing Sheets

PROCESS AND APPARATUS FOR PROVIDING IDENTITY MARKS ON SECURITY DOCUMENTS

Figure 1:
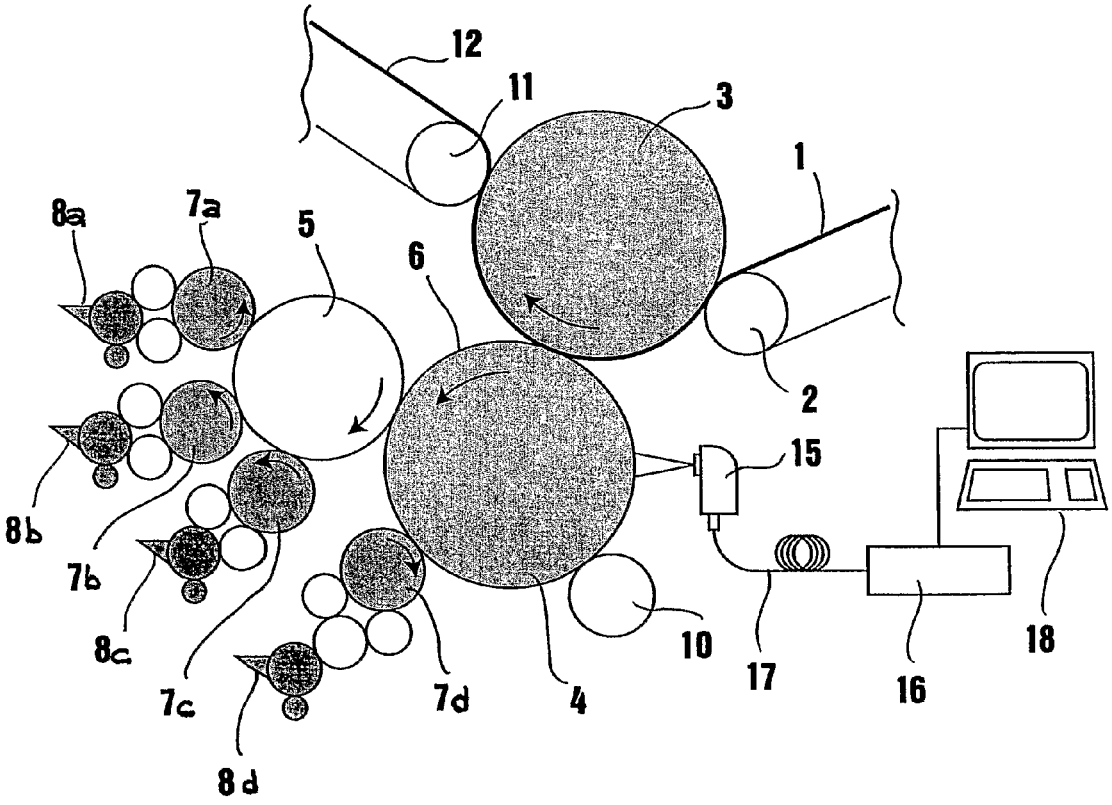

This application claims the benefit of co-pending PCT Patent Application Serial No. PCT/CH2005/000169, filed Mar. 23, 2005, which is now International Publication Number WO 2005/090088, published Sep. 29, 2005, which claims priority to European Patent Application No. EPO4405180.3, filed Mar. 24, 2004.

The present invention belongs to the field of the processes and apparatus intended to provide security documents with variable data, each security document having an individualised identity mark offering improved security against copies or falsification.

The term "security document" designates here primarily banknotes, but also designates documents of any kind having or supporting financial value like excise or tax stamps, postal stamps, cheques, lottery tickets, title deeds, stocks, bonds and other non-banknote bearer documents, passports and other forms of identity documents, credit and other forms of payment cards, product labelling, certificates of origin, and the like. The term "identity mark" designates here any sign, readable either by the human eye or by a specific machine, whose characteristics may be stored in a file and varied such that each security document may thereby be distinguished from any other security document of the same type. Identity marks include, as examples, but are not limited to, serial numbers, barcodes, geometrical sequences, punchings, magnetically encoded zones, and the like. The term "substrate" designates primarily paper or synthetic polymer materials and laminated structures incorporating synthetic or metallic films in sheet or web form.

Particularly, the present invention concerns processes and apparatus combining a printing press and a laser marking station.

It is well known in the field of security printing to provide authenticating marks by directing laser radiation from a laser light source on the substrate to form authenticating marks. An example of such a process is described in U.S. Pat. No. 4,740,269 (Berger et al.): the marks are generated by local burning or vaporisation of material from a paper sheet or web by a laser marking station comprising a computer controlled pivotable mirror device, which allows, by controlled deflection of the laser radiation to generate any desired pattern.

U.S. Pat. No. 4,579,754 (Maurer et al.) discloses a process for generating information on an identification card by means of an IR emitting laser, by providing a film layer being transparent to visible light but transformable by IR radiation over the imprinted substrate layer and exposing the transformable layer to a pulsed laser beam, thereby producing local transformations such as discolorations, microbubble formation, evaporation and the like within the film, whereas substantially not affecting any other card layer. The information exists in the form of local changes in the optical properties of the treated areas. The nature of the transformation in the marked areas at the microscopic level may be easily checked, rendering falsification difficult.

Laser marking technology has high flexibility and can mark with very high resolution. The applicant developed a laser marking device comprised of laser light sources, marking head units, covers and fume extraction systems. This device is integrated in KBA-GIORI's typographic presses to mark IR absorbent material printed on the substrate, or optical variable devices (OVD) applied on the substrate, where as leaving this substrate substantially unaltered, during the last production stage of the security documents.

The intaglio printing process has long been a favourite in the banknote printing industry. In the intaglio process, an engraved metal printing plate is covered with ink. The outer surface of each plate is then wiped clean, allowing the ink to remain in the cuts, i.e. in the design and letter grooves of the plates. Each sheet is then forced, under heavy pressure, into the finely recessed grooves of the printing plate to pick up the ink. The printed surface of the banknotes is this slightly raised, while the reverse side is slightly indented, so that the printing impression is three dimensional. The unique feel in touch of banknotes made by the intaglio print process is one of the most important overt security features in the banknote printing industry.

Intaglio printing equipment itself, as known in the art, can not provide varying identity marks. It appears thus desirable to combine the advantages of the intaglio printing technology with a variable marking technology, i.e. high resolution laser marking technology.

Specifically, the present invention concerns the association of a laser marking device with an intaglio printing press for printing security documents comprising a plate cylinder with at least one engraved printing plate, an impression cylinder, a wiping device and an inking system. Such an inking system may comprise a collector inking cylinder interacting with said printing plate, a plurality of color selector cylinders placed one beside the other around part of the circumference of the collector inking cylinder, and inking devices associated with each color sector cylinder. Inking systems of this type are described in applicant's patents EP 0406157 and EP 0873866.

Standard intaglio inks can not be marked by laser. But infrared absorbent pigments can be added to intaglio inks, thereby providing IR security inks. IR security inks absorb IR wave bands of light outside the visible spectrum, laying between 750 and 1150 nm. Such IR inks are often used in intaglio printing as machine-readable features and provide a covert authentication feature.

It has thus been already proposed to use prints made by means of IR security inks as a transformable layer to be submitted to an IR laser beam of a laser marking station. As a preliminary step, a printed layer of IR security ink is applied to the paper or polymer substrate. The print should preferably be dried before it is submitted to the laser marking station. This layer comprising materials reacting to the laser beam is then ablated locally during the marking process, i.e. removed by melting or instant evaporation under the effect of the intense heating flux during a very short time on the small surface touched by the laser spot. The marking process depends upon the peak power and the duration of the laser pulse; the longer the interaction time, the higher is the heating flux transferred to the material. The substrate underneath, whether it be paper or polymer, should to the utmost extent not be burned by the laser beam. Thus all these parameters have to be carefully selected and set to achieve a correct result.

Thus, the aim of the present invention is to propose another process associating intaglio printing and laser marking offering enlarged capability of implementation.

According to a first aspect, an object of the invention in its broadest sense is an improved printing process, wherein a printing plate or cylinder bearing ink at its surface within a predetermined area, transfers said ink onto a sheet or web, thereby imprinting a corresponding area of said sheet or web, the improvement consisting in directing a laser beam of a laser marking device onto said predetermined area of the wet inked surface of said plate or cylinder just before said area of plate or cylinder contacts said sheet or web, wherein the parameters of the laser irradiation are selected and set so as to evaporate the wet ink along a path defining an identity mark, so that the printed sheet or web remains empty of ink within the corresponding area of the sheet or web along the said path.

More particularly, an object of the present invention is a process for providing identity marks on security documents imprinted by means of an intaglio printing process, wherein an intaglio printing plate is covered with ink, wherein the surface of said plate is then wiped clean, allowing the ink to remain in the cuts of the plate, a predetermined area of said plate being thus inked according to an intaglio pattern, wherein thereafter, and before the printing plate comes in contact with the substrate to be imprinted, a laser beam of a laser marking device is directed onto said predetermined area of said printing plate, the laser spot is moved along the path of an identity mark, and parameters of said laser beam are selected and set so as to evaporate the wet ink present in said cuts along said path.

According to the invention, the laser beam is set at an intensity level so as to evaporate only the wet ink and not to react with the material of the printing plate or cylinder, i.e. not to damage the chromed plate in case of the intaglio process.

Those skilled in the art will recognise that it is much easier to set a suitable intensity level of a laser beam that evaporates wet ink totally without any damage to the vessel functioning metal substrate of a plate, than to adjust an intensity level so as to evaporate printed solid ink pigments without substantially damaging the interpenetrated cellulosic fibres of a paper substrate or the white opaque layer of a polymer substrate.

Since the laser beam is not directed onto the paper or polymer substrate, the sensitivity of the substrate to the laser beam has not to be taken in consideration. Thus, a wider range of substrates may be processed.

The component of the ink absorbing light energy, i.e. the IR absorbing component if the laser is an IR emitting laser, may be a pigment, but may be also another component, for example a solvent component. The laser, or the lasers of the marking device may be selected among IR emitting lasers, visible light emitting lasers and UV emitting lasers. Thus, the process according to the invention may be used with a wider range of inks than the laser marking processes of the prior art. Furthermore, it is contemplated to apply the process according to the invention to various varnishes, polymer conductive materials and the like, in as far as they react with a suitable laser light and may be processed by a printing machine.

The inventive process offers a new type of identity mark, at the microscopic level: whereas the known identity marks made by means of laser marking stations exist in form of "burn traces" or other traces of photochemical reactions as mentioned above, the identity marks provided by the present invention exist in form of merely unprinted paths within a printed area.

According to a second aspect, an object of the invention in its broadest sense is an improved printing press, wherein a printing plate or cylinder bearing wet ink at its surface within a predetermined area, transfers said ink onto a sheet or web, thereby imprinting a corresponding area of said sheet or web, the improvement consisting in a laser marking device arranged for directing a laser beam onto said plate or cylinder at a location of said press selected so that said laser beam hits said predetermined area of plate or cylinder before said area of plate or cylinder contacts said sheet or web, wherein the parameters of the laser irradiation are selected and set so as to evaporate the wet ink along a path defining an identity mark, so that the printed sheet or web remains empty of ink within the corresponding area of the sheet or web along the said path.

A further object of the present invention is an intaglio printing machine for printing security documents, of the above defined type, comprising a laser marking device arranged facing said plate cylinder downstream from said wiping device and upstream from the contact zone between said plate cylinder, said substrate and said impression cylinder.

The intaglio printing press according to the invention may be a sheet fed intaglio-printing press.

The intaglio-printing press according to the invention may be a web intaglio-printing press.

The printing plate of the machine may comprise an area travelling in front of the laser-marking device, engraved with a plurality of discrete dots or cells. These cells may be arranged in contiguous rows and columns.

Preferably said laser marking device comprises an array of laser marking heads, the number of heads being equal to the number of columns of security documents to be printed on a sheet or a web.

Figure 4:
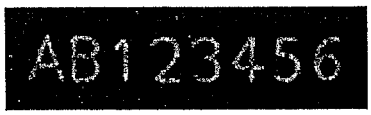
Figure 2A:
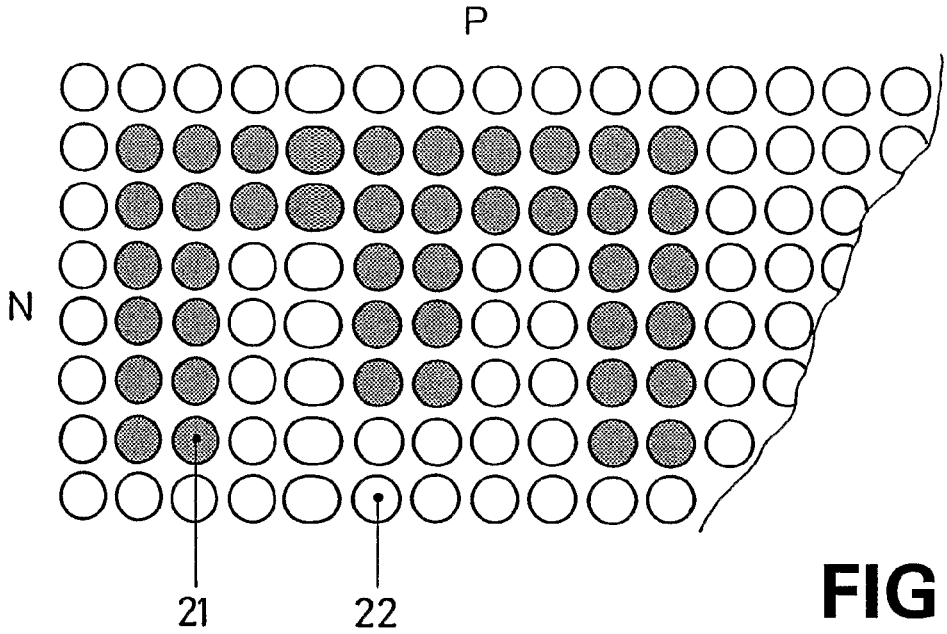
Figure 2B:
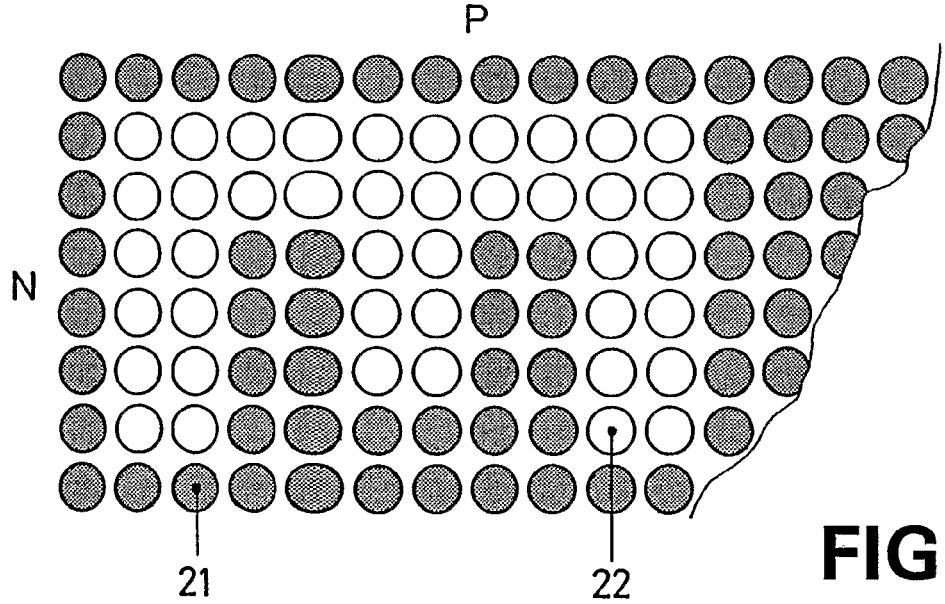
Figure 3:
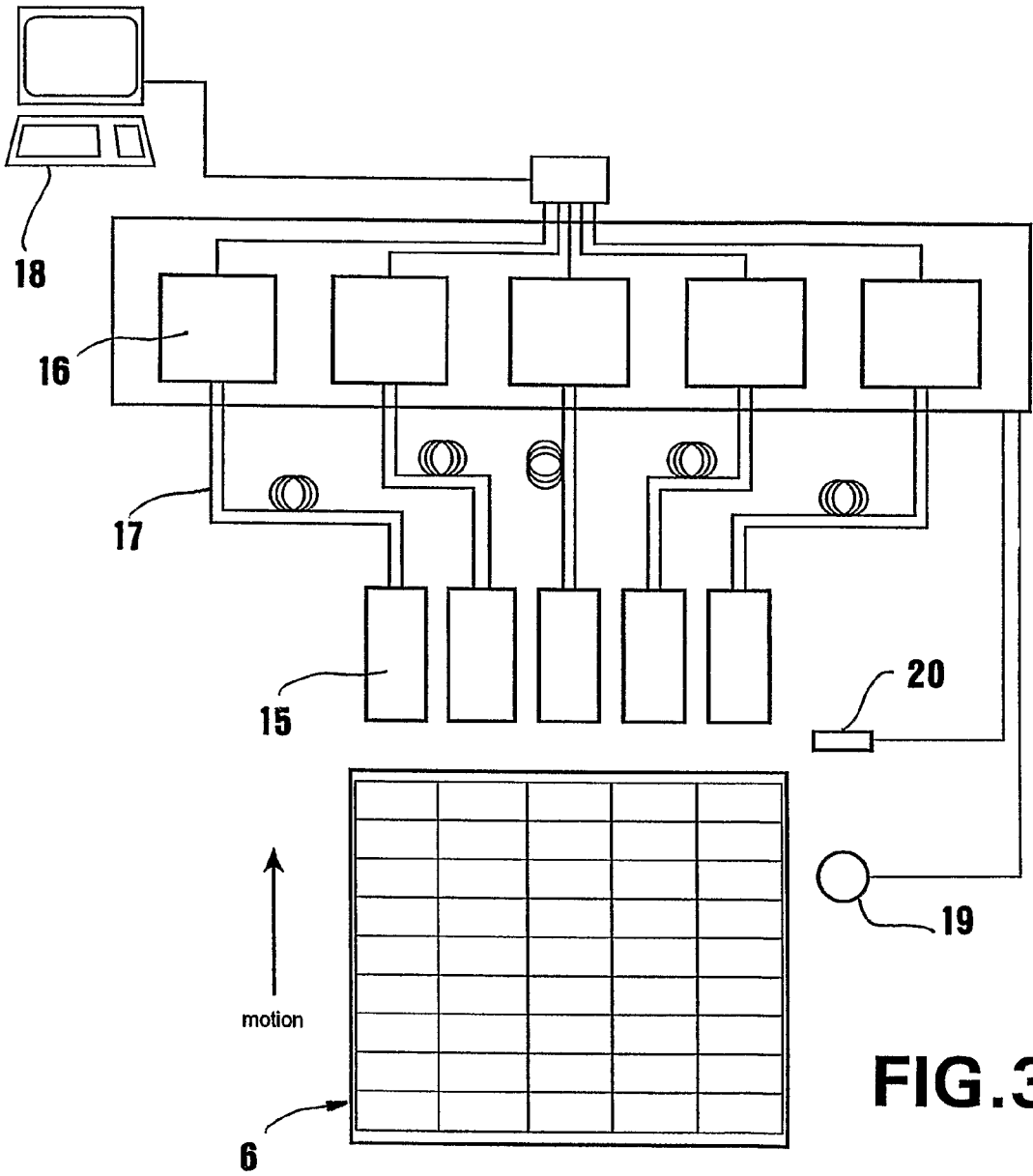

Further particularities and advantages of the inventive process and the inventive machine will appear to those skilled in the art from the following description of the preferred embodiment, in connection with the drawing, wherein:

FIG. 1 is a diagrammatic longitudinal cut through a sheet-fed intaglio printing machine, FIGS. 2*a* and 2*b* are enlarged schematic views of a portion of an area of a printing plate engraved with an array of contiguous cells, FIG. 3 is a schematic view illustrating the integration of marking heads and laser sources in the printing press, and FIG. 4 shows an identity mark.

The machine depicted in FIG. 1 comprises an impression cylinder 3 interacting with a plate cylinder 4, these two cylinders having the same diameter, and a collector inking cylinder 5 in contact with the plate cylinder 4. The ratio between the diameter of the collector inking cylinder 5 and the diameter of the plate cylinder 4 is equal to ⅔. The plate cylinder 4 is fitted with a number of engraved printing plates 6, which are uniformly distributed around its periphery. In this instance, the plate cylinder 4 carries three printing plates 6. The impression cylinder 3 therefore carries three blankets and the collector-inking cylinder 5 has two blankets. Along part of the periphery of the collector inking cylinder 5 which has an elastic surface, there are mounted three color-selector cylinders 7*a* to 7*c*, each associated with an inking device 8*a* to 8*c* which inks the corresponding color-selector cylinder. The diameter of the color-selector cylinders is equal to ⅓ of the plate cylinder 4. A fourth color-selector cylinder 7*d* with an inking device 8*d* inks directly the plate cylinder 4.

The color-selector cylinders 7*a* to 7*d* have a surface made of a hard material and each selector cylinder has regions in relief, the contours of which correspond to those of the surfaces to be printed in the respective color. This being the case, the hard surface of the reliefs of the selector cylinders interacts with the elastic surface of the collector cylinder. The direction of rotation of the various cylinders is depicted by curved arrows in the drawing. The terms "upstream" and "downstream" as used herein refer to these arrows.

A wiping device 10 is also provided at the periphery of the plate cylinder 4, and comes after the collector inking cylinder 5 in the direction of rotation; this cylinder cleans the surface of the engraved plates away from the intaglio cuts and pushes the ink into said cuts.

Paper in sheet form is fed to the machine by a sheet feed device 1 and a transfer cylinder 2, which hands the sheets to the impression cylinder 3. The paper, held on this cylinder by grippers, passes between this cylinder and the plate cylinder 4, where it is printed. It is then transported by another transfer cylinder 11 onto a transport device 12.

A laser marking station is integrated in the printing press. It comprises a number of laser sources 16 and a number of marking heads 15, said number being equal to the number of columns of security documents of a sheet or web. In this application, each laser source is a YAG crystal type laser emitting infra red light, with diode pumping and air cooling systems. The duration of the laser pulse is of the order of 100 nanoseconds for a Q switched laser type. An advantage of an IR laser is that the light can be transmitted through optical fibres 17 allowing the laser sources to be installed outside the machine at some distance from each of the marking head units, which are directly arranged in front of the plate cylinder 4, downstream from the wiping device 10, as shown diagrammatically in FIG. 1.

Each marking head subunit contains a 2-axis galvanometer system, made up of two moving mirrors, which are precisely controlled by computer 18 to allow the laser beam to mark the notes at very high speed. A theta lens focuses the laser beam onto the marking area. The typical laser spot size diameter is within the range of 200-300 μm. The type of data to be marked may be alphanumerical characters with all types of fonts, hieroglyphic characters, 2D codes, vignettes, logos, guilloche patterns, or data from a remote database. The marking speed depends to a large extent upon the type of data as well as a pitch between the marking jobs.

FIG. 3 shows a schematic view of all the components installed on and beside the press. An encoder 19 and a photocell 20 allow the synchronising of the printing plate 6 motion with the marking job. In FIG. 3, the curved printing plate is schematically shown as a rectangle engraved for printing 9×5 security documents. The working distance between the lens of each marking head and the printing plate is within the range of 20 cm. The array of marking heads subunits are installed in a frame. The complete frame can be easily removed for maintenance purposes. Furthermore an extraction system of laser fumes (not shown in the drawing) is placed under the marking heads to evacuate ablated droplets and fumes. Pressure pumps with adapted filters are used to generate reduced pressure required to keep the rotating cylinders free of particles of fumes and dust. The system ensures that contaminants do not escape into the workspace.

FIG. 4 shows an enlargement of an intaglio printed portion of a security document with an identity mark according to the present invention appearing as a non imprinted pattern. The variable mark according to the invention may be superimposed within an existing non variable intaglio pattern (portrait, background and the like) by ablating wet ink within selected portions of the existing furrows of the intaglio printing plate.

The ablative process is extremely fast, the time span between the ablation and the entry into contact with the paper sheet is also very short and intaglio ink is not very fluid, so that ink surrounding the irradiated areas of the printing plate does not spontaneously flow into the emptied portions. Nevertheless, one could believe that under effect of pressure upon the intaglio printing step, some ink may be pushed laterally and blur the mark. But it is worthwhile to notice that if a laser spot crosses an inked engraved line, ink could thereafter be pushed into the emptied portion of the cut only from 2 opposite sides along the cut, not from all sides. Even this may be prevented by providing shallow portions along a cut. If a laser spot follows the path of an engraved inked line or crosses an engraved dot, the cut is completely emptied and ink from neighbouring cuts cannot flow to the emptied ones. Thus this kind of identity mark exhibits a well defined outline.

According to a preferred embodiment illustrated in FIGS. 2*a* and 2*b*, the portion of the printing plate that shall support the identity mark is engraved by an area of discrete cells 21 for example a rectangular array arranged in n rows and p columns. Such an engraving may be realised by known methods, but is preferably performed according to the process disclosed in applicants copending application WO 03/103962, the content of which is incorporated herein by reference. Thus, the array of n×p cells constitutes the precursor of an image of n×p pixels, obtained after inking, wiping, emptying by ablation selected cells 22 and finally intaglio printing. This image is the identity mark obtained by the process. As may be seen from FIGS. 2*a* and 2*b*, it is possible as well to print an inked sign surrounded by a non-inked background as a non-inked sign on an inked background.

In summary, the present invention is not concerned with a mere addition of a conventional identity mark on a security document already imprinted by an intaglio printing process, by means of a laser marking station downstream from the printing press, but offers for the first time a true variable intaglio printing system.

Although the invention was described to be applied to intaglio printing, it can of course also be applied to other printing processes, such as for example offset printing, flexographic printing or silk screen printing, by directing the laser beam on the surface of a printing plate or printing cylinder bearing wet ink.

The invention claimed is:

1. A printing process wherein a printing plate bearing wet ink at its surface within a predetermined area transfers said wet ink onto a sheet or web, thereby imprinting a corresponding area of said sheet or web, including a step consisting of directing a laser beam of a laser marking device onto said predetermined area of the wet inked surface of said printing plate to evaporate wet ink from the wet inked surface just before said area of said printing plate contacts said sheet or web, wherein the fluidity of said wet ink, the speed of the laser irradiation and the timespan between the laser irradiation and the entry into contact of said area of said printing plate with said sheet or web are selected and set so that said wet ink is completely evaporated along a path defining an identity mark, said identity mark existing in form of merely unprinted paths within a printed area, and so that said wet ink contained in the areas of said printing plate surrounding said path does not spontaneously flow into said path.

2. A process as claimed in claim 1, wherein said printing plate is an intaglio printing plate.

3. A process as claimed in claim 1, wherein said wet ink comprises at least one solid component, in particular a pigment, absorbing the radiation emitted by said laser marking device.

4. A process as claimed in claim 1, wherein said wet ink comprises at least one liquid component, in particular a solvent, absorbing the radiation emitted by said laser marking device.

5. A printing process wherein a printing cylinder bearing wet ink at its surface within a predetermined area transfers said wet ink onto a sheet or web, thereby imprinting a corresponding area of said sheet or web, including a step consisting of directing a laser beam of a laser marking device onto said predetermined area of the wet inked surface of said printing cylinder to evaporate wet ink from the wet inked surface just before said area of said printing cylinder contacts said sheet or web, wherein the fluidity of said wet ink, the speed of the laser irradiation and the timespan between the laser irradiation and the entry into contact of said area of said printing cylinder with said sheet or web are selected and set so that said wet ink is completely evaporated along a path defining an identity mark, said identity mark existing in form of merely unprinted paths within a printed area, and so that said wet ink contained in the areas of said printing cylinder surrounding said path does not spontaneously flow into said path.

* * * * *

UNITED STATES PATENT AND TRADEMARK OFFICE

CERTIFICATE OF CORRECTION

PATENT NO. : 8,117,964 B2
APPLICATION NO. : 10/592646
DATED : February 21, 2012
INVENTOR(S) : Moreau It is certified that error appears in the above-identified patent and that said Letters Patent is hereby corrected as shown below:

- column 2, line 4, “this” should be replaced by --thus--

Signed and Sealed this
Third Day of April, 2012

David J. Kappos

David J. Kappos
*Director of the United States Patent and Trademark Office*